US006081936A

United States Patent [19]

Bargman et al.

[11] Patent Number: 6,081,936

[45] Date of Patent: Jul. 4, 2000

[54] METHOD AND ARRANGEMENT FOR AUTOMATICALLY RAISING AND LOWERING A TOILET SEAT

[75] Inventors: Ronald David Bargman, Beverly Hills; Ioslav Umanskly, Farmington Hills, both of Mich.

[73] Assignee: Ronald D. Bargman, Beverly Hills, Mich.

[21] Appl. No.: 09/096,234

[22] Filed: Jun. 11, 1998

Related U.S. Application Data

[60] Provisional application No. 60/049,184, Jun. 11, 1997.

[51] Int. Cl.[7] ..... A47K 13/10

[52] U.S. Cl. ..... 4/246.1; 4/241; 4/246.2

[58] Field of Search ..... 4/246.1, 241, 246.2

[56] References Cited

U.S. PATENT DOCUMENTS

| | | | |
|---|---|---|---|
| 2,632,896 | 3/1953 | Morikawa | 4/246.1 |
| 5,014,367 | 5/1991 | Gamblin | 4/246.2 |
| 5,020,165 | 6/1991 | Huang | 4/246.2 |
| 5,138,724 | 8/1992 | Chien et al. | 4/241 |
| 5,435,017 | 7/1995 | Pan | 4/246.2 |
| 5,461,734 | 10/1995 | Faircloth | 4/246.1 |
| 5,857,223 | 1/1999 | Ferdinand | 4/246.1 |
| 5,867,843 | 2/1999 | Robello et al. | 4/246.1 |
| 5,940,896 | 8/1999 | Berring | 4/241 |

*Primary Examiner*—Henry J. Recla
*Assistant Examiner*—Peter deVore
*Attorney, Agent, or Firm*—John R. Benefiel

[57] ABSTRACT

An arrangement and method for automatically raising and lowering a toilet seat including a sensor pad located to be stepped on only by a standing user. The toilet seat is counterbalanced, and a shifting of weight causes the seat to pivot up or down. Various weight shifting arrangements are described, including an electromechanical drive, a liquid transfer system, and a mechanical drive weight positioner.

16 Claims, 16 Drawing Sheets

METHOD AND ARRANGEMENT FOR AUTOMATICALLY RAISING AND LOWERING A TOILET SEAT

CROSS REFERENCE TO RELATED APPLICATION

This application claims priority of provisional application 60/049,184 filed on Jun. 11, 1997.

BACKGROUND OF THE INVENTION

This invention concerns arrangements for raising or lowering toilet seats. The need to raise the seat for use by males is a longstanding inconvenience, and for subsequent female users if the seat is left raised.

Thus a great many devices have been devised over many years for assisting raising or lowering toilet seats to make use more convenient.

None of those devices have been successful for various reasons. Some are manually operated requiring the attention of the user to raise and/or lower the seat after use of the toilet.

It is the object of the present invention to provide a method and arrangement for automatically raising and lowering a toilet seat not requiring any conscious effort by a user, and which is simple, reliable, and able to be manufactured at low cost.

SUMMARY OF THE INVENTION

The above recited object and others will be achieved upon a reading of the following specification and claims are achieved by establishing a counterbalanced toilet seat mounted for hinging movement about a fulcrum, with an arrangement for temporarily unbalancing the toilet seat so as to cause the toilet seat to be raised when a person stands facing the toilet bowl with his feet closely adjacent thereto. This is caused by the pressure of a person's feet acting on a sensor pad located on the floor in a position to be stepped on by a person facing the bowl. The sensor pad can itself generate an actuation force or fluid pressure, or a switch in the pad can be operated to energize a drive motor to carry out the imbalancing. When the person moves away, and foot pressure on the sensor pad is removed, the toilet seat is caused to be unbalanced in a sense so as to cause the seat to be automatically lowered.

The counterbalancing is achieved by arranging the hinging of the toilet seat so as to define a fulcrum, with a counterweight (or spring) to the rear of the fulcrum provided, counterbalancing the weight of the toilet seat.

In a first embodiment, the unbalancing is achieved by causing a flow of a volume of liquid from a cavity in the toilet seat to an external reservoir, or between cavities on either side of the fulcrum. In one arrangement, the liquid is forced from the cavity on one side of the fulcrum by foot pressure on the sensor pad expanding a bladder in the cavity. When foot pressure is released, the bladder compresses to allow the liquid to be forced back into the cavity and recreate the imbalancing causing lowering of the seat.

In the preferred embodiment version using liquid transfer to create imbalances, the liquid is forced from a cavity on one side of the fulcrum to a cavity on the other side, and vice versa to create an imbalance tending to raise or lower the toilet seat.

In another preferred embodiment, a battery powered reversible motor drives a weight engaged with a power screw between respective unbalancing positions on either side of the fulcrum, the sensor pad mounting an electrical switch or remote control transmitter for energizing the drive motor in either direction.

A mechanical embodiment is also described which utilizes a foot pressure operated mechanical actuator to pull a cable with weights against a retracting spring, to shift the weights with respect to the fulcrum and create the unbalanced conditions.

DESCRIPTION OF THE DRAWING FIGURES

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
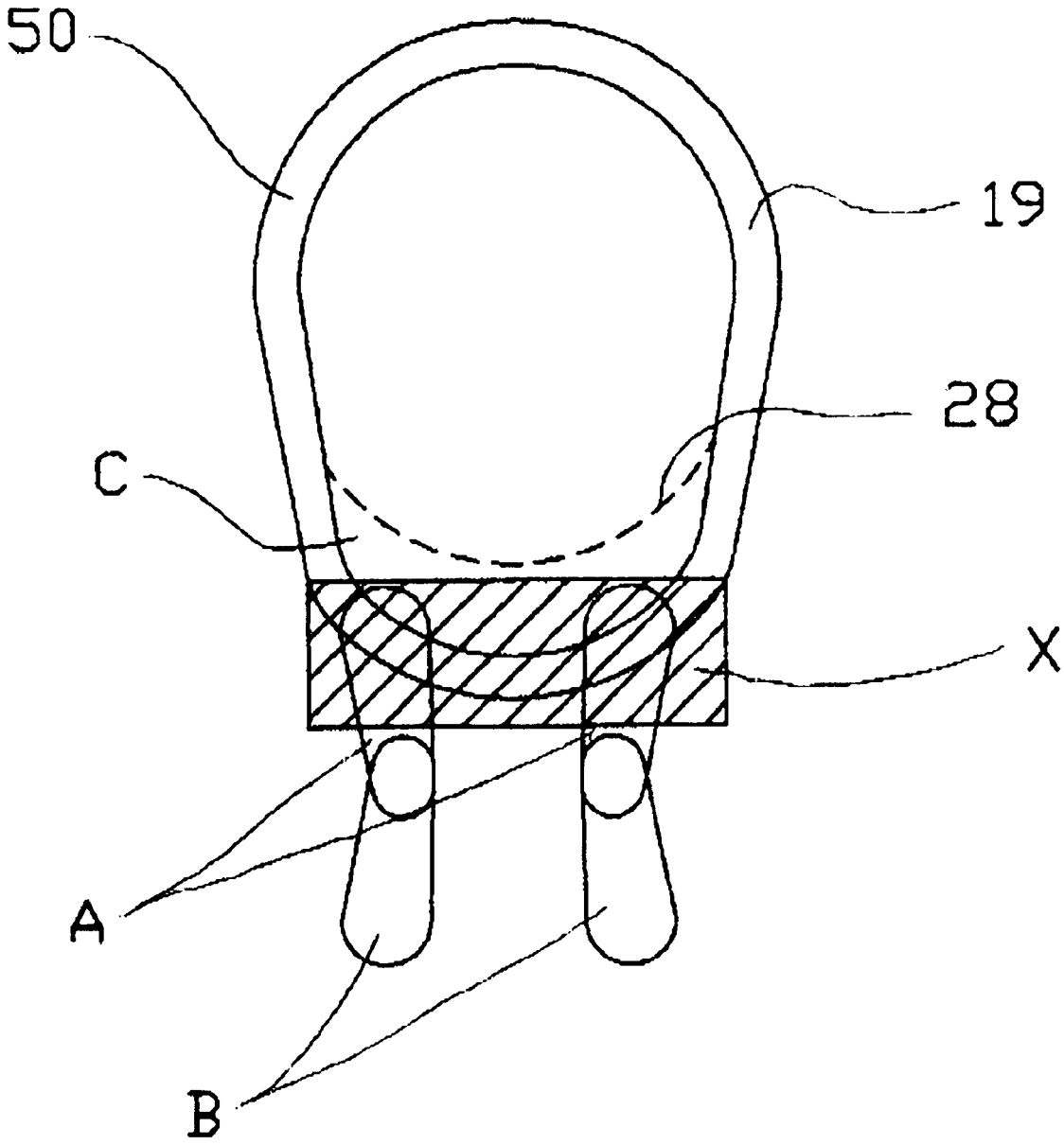
FIG. 1 is a plan view diagram of a toilet showing the two different regions within which the feet of a toilet user are positioned depending on the mode of use.
Figure 2:
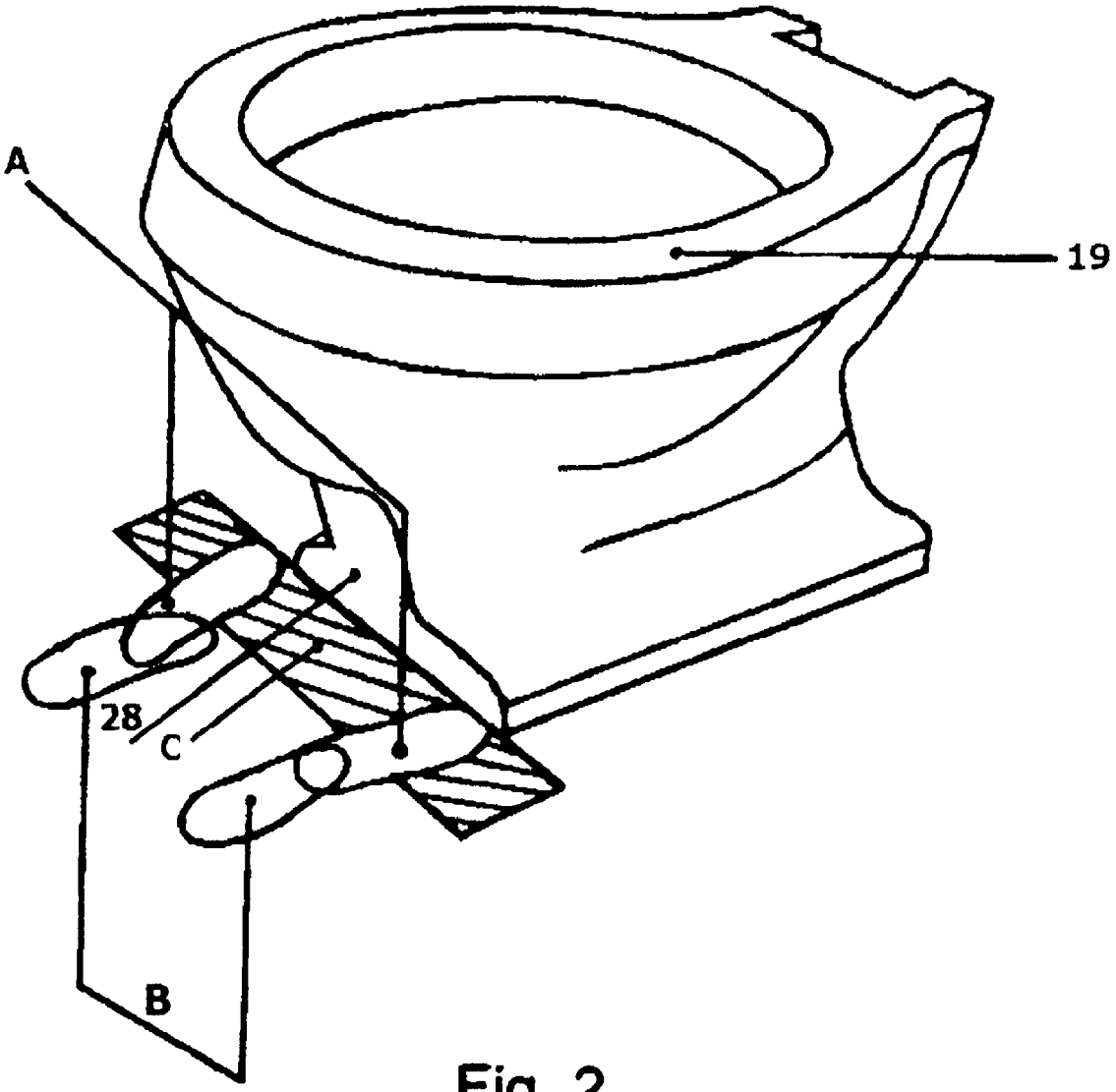
FIG. 2 is a perspective view of a toilet bowl with a diagram of the respective regions with which the feet of a user are positioned in different modes of use of the toilet.

Referring to FIGS. 1 and 2, a toilet bowl 50 with a rim 19 is shown, which typically extends forwardly of the base 28 of the toilet bowl to create an overhang C. This geometry creates an inner floor region X (shown shaded) lying beneath the overhang and extending a short distance beyond the overhang, which is stepped on by a standing user facing the toilet (see foot outlines A). A seated user's feet (see outlines B), are facing the other way and do not enter that region.

This fact is relied on to establish automatic sensing of the user's needs with respect to whether the toilet seat 1 (FIG. 3A) should be raised or lowered.

According to the concept of the present invention, a sensor pad is located at least partially within the floor region X and caused to activate toilet seat raising, which is maintained when foot pressure in region X is detected or applied. The toilet seat 1 is automatically lowered when foot pressure is no longer detected or applied.

FIGS. 3A—3E illustrate one embodiment of the arrangement used to automatically raise and lower the toilet seat.

The arrangement includes the counterbalancing of the toilet seat 1 with respect to its hinging axis, essentially using the hinge 52 as a fulcrum. The counterbalancing may be achieved by mounting a counterweight 8 to the rear of the toilet seat, located on the opposite side of the hinge 52 from the center of gravity of the toilet seat 1 itself. The counterweight 8 is of a heavy material, such as a rod of metal, i.e., steel or brass, which may be molded or installed in a cavity within the toilet seat 1. Other means of counterbalancing include springs, or springs and weights, etc.

The toilet seat 1 rear portion housing the counterweight 8 is angled upwardly from the rim 19 to provide a clearance when the toilet seat 1 is hinged upwardly to be raised. In addition, the hinge standard 54 as well as the pad 7 elevates the toilet seat 1 to also create clearance accommodating the rear counterweighted portion as the toilet seat 1 moves to a raised position. In the fully raised position, the toilet seat 1 is still inclined forwardly somewhat as shown, to allow imbalances about the fulcrum to occur.

The toilet seat 1 may have a forward portion of hollow lightweight construction (which may have internal ribs as described below) to enable counterbalancing of its entire weight forward of the fulcrum by the counterweight 8.

Means are provided for shifting weight supported by the toilet seat 1 with respect to the fulcrum so as to selectively create an imbalance tending to raise or lower the toilet seat.

Figure 3A:
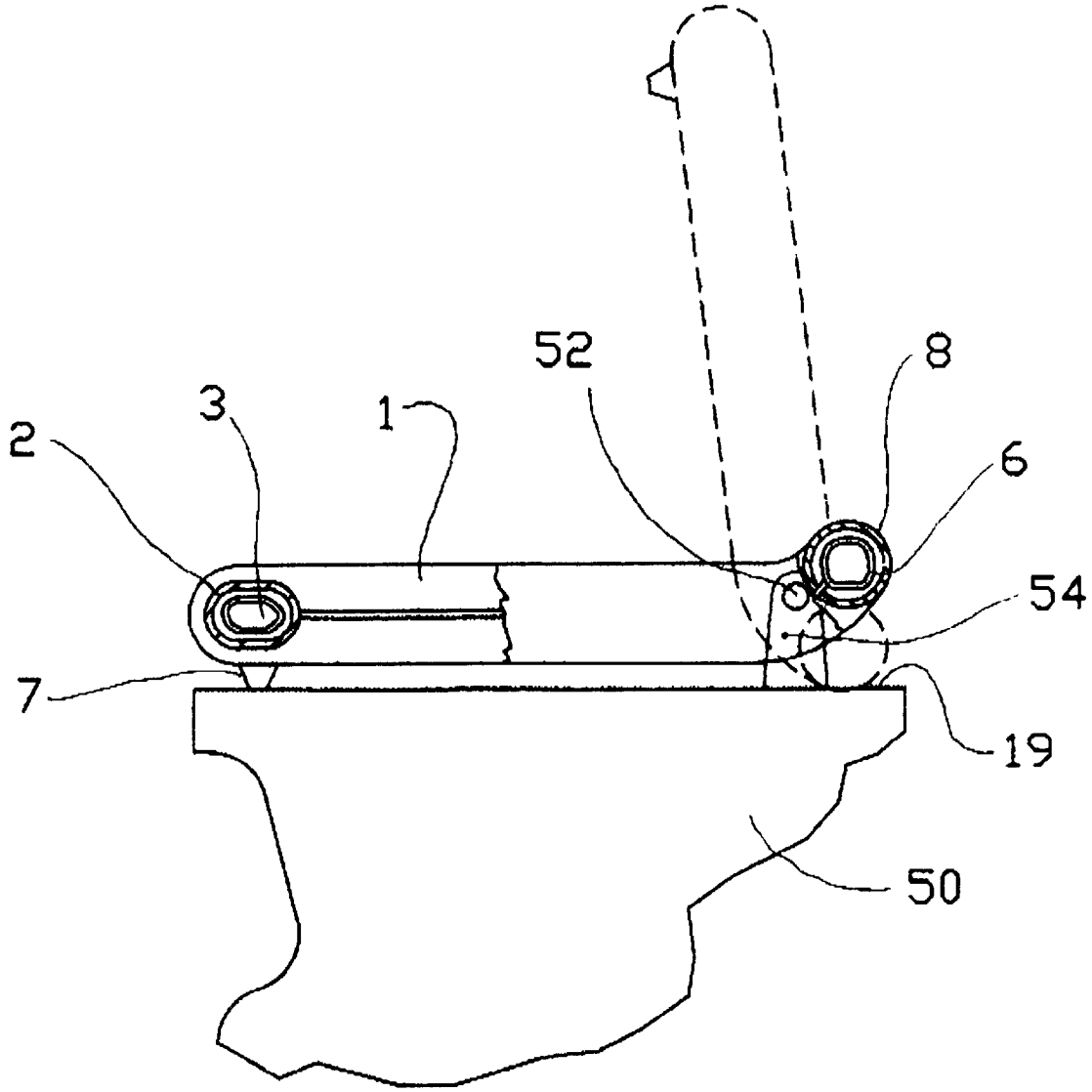
FIG. 3A is a fragmentary side view of a toilet bowl and seat in partial sections incorporating a first embodiment of the invention utilizing fluid movement for created unbalanced conditions of the toilet seat.
Figure 3B:
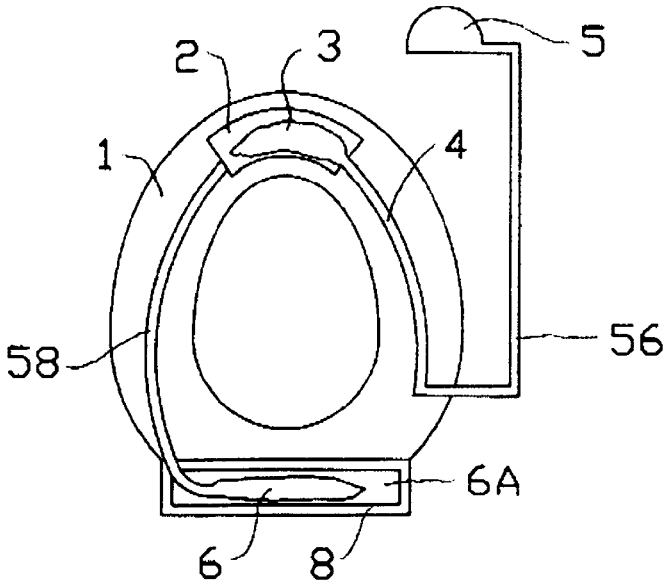
FIG. 3B is a diagrammatic plan view of a toilet seat incorporating a first embodiment of the invention utilizing fluid movement for created unbalanced conditions of the toilet seat.

In the embodiment of FIGS. 3A, 3B, means are provided for forcing a liquid out of a cavity 2 located within the toilet seat 1 at the forward end, activated by foot pressure acting on a sensor pad 5 in floor region X. In this embodiment, the sensor pad 5 is used as an actuator to compress air when stepped on, exerting pressure on a resilient bladder 3 and passage 4 in the seat 1 in cavity 2 via an air line 56, causing the liquid in cavity 2 to be forced out and into a second bladder reservoir 6 in a cavity C within the counterweight 8 via line 58.

This movement of a dense liquid such as glycerine, causes a weight shift to create an imbalance about the fulcrum defined by hinge 52, such that the seat is caused to be hinged up automatically by the weight of the counterweight 8 and transferred liquid.

When the foot pressure is removed, a vacuum may develop causing the bladder 3 to contract, and liquid is drawn back into the cavity 2 gradually establishing an imbalance tending to lower the seat back onto the rim 19. Return of the liquid can be accomplished by providing gas pressure in the cavity C surrounding the bladder reservoir 6.

The flow passages are restricted to produce a reasonable rate of motion of the toilet seat in being raised and lowered to avoid seat impacts.

Figure 3C:
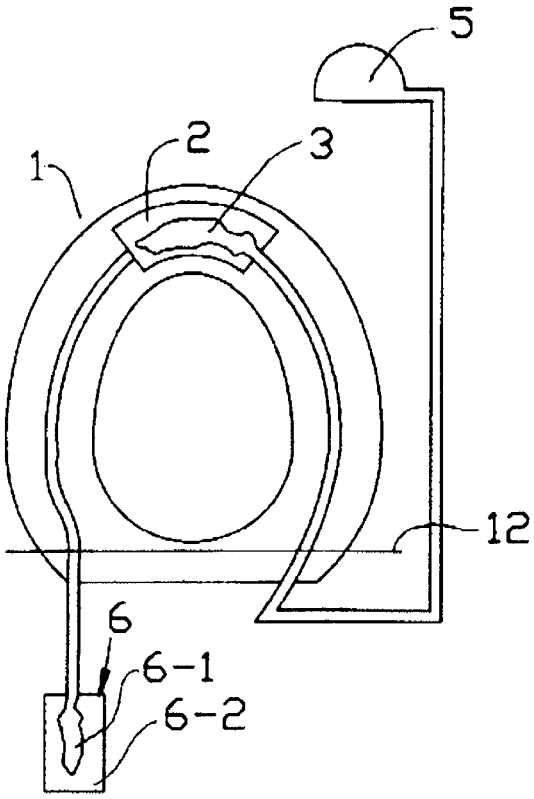
FIG. 3C is a fragmentary plan view of a toilet seat incorporating a preferred variation of the fluid transfer system for creating unbalanced conditions.
Figure 3D:
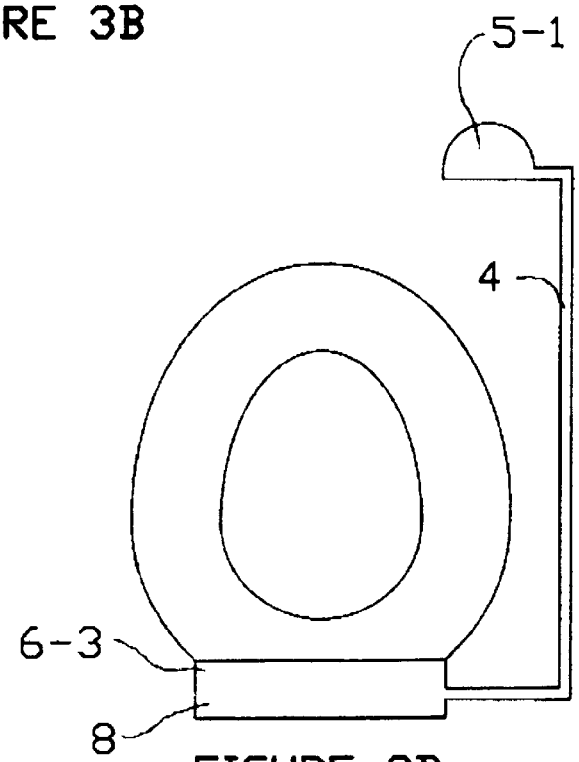
FIG. 3D is a diagrammatic plan view of a toilet seat and associated components according to another variation of the fluid transfer embodiment.

FIGS. 3C and 3D show variations of the arrangement using liquid movement to create the desired imbalances.

In the variation of FIG. 3C, foot pressure on the floor sensor pad 5 causes air pressure inflation of the bladder 3. Liquid is displaced from cavity 2 into a reservoir 6-2 which is located externally of the seat. Thus, a transfer of weight from the forward side of the fulcrum 12 is accomplished to create the desired imbalance.

FIG. 3D shows a transfer of liquid from the foot pad 5-1 the cavity 6-3, and back to the foot pad 5-1.

Figure 3E:
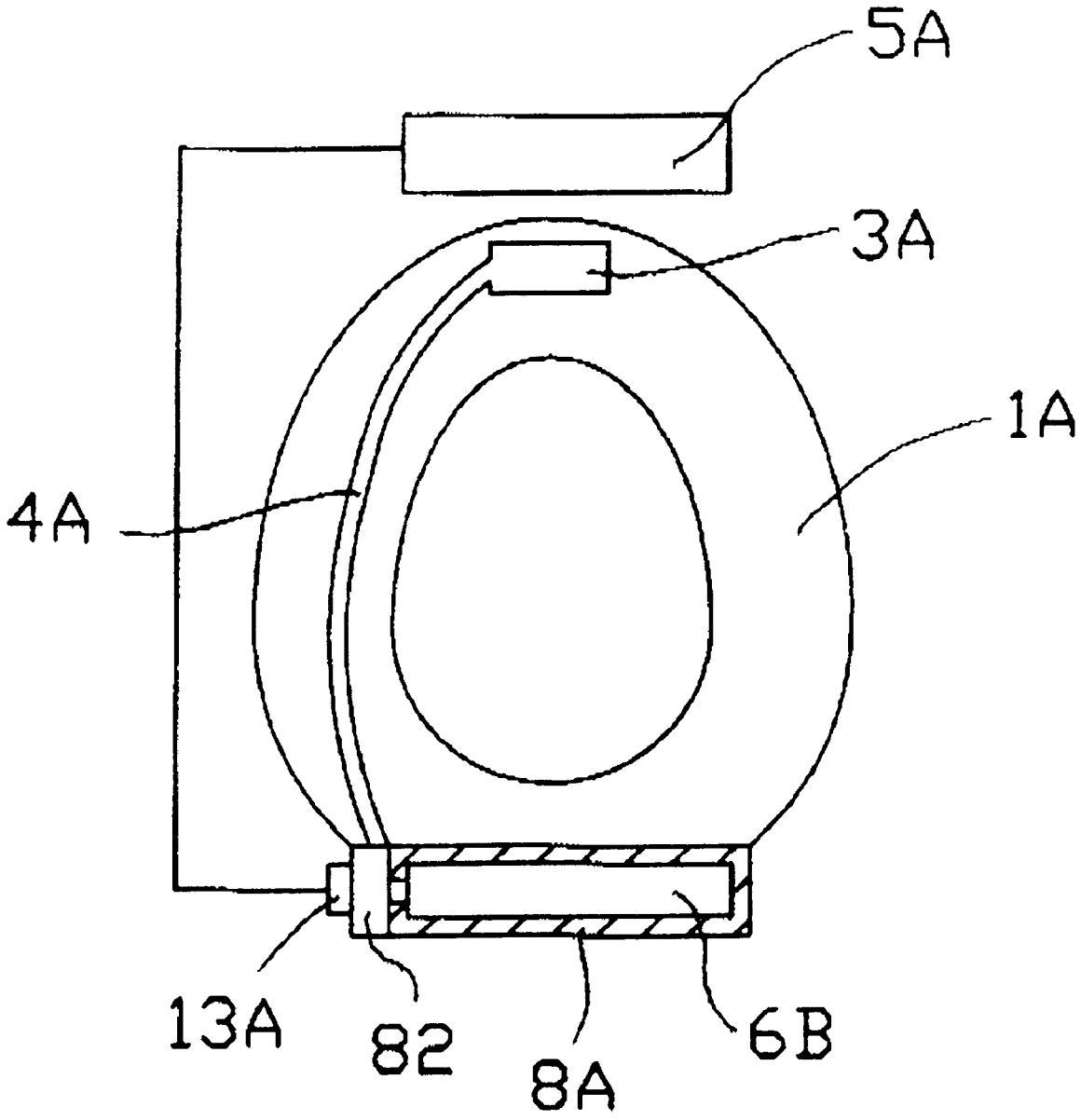
FIG. 3E is; a plan view diagram of yet another variation of the fluid transfer embodiment of the invention which utilizes an electrically driven pump.
Figure 4A:
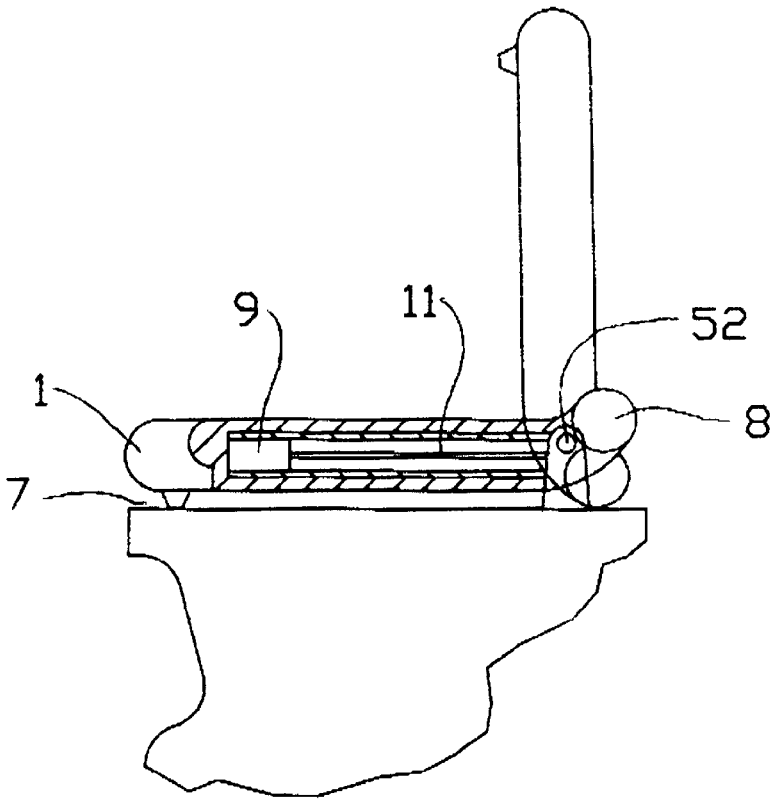
FIG. 4A is a fragmentary side view of a toilet bowl with a partially sectional view of an associated toilet seat according to second embodiment: of the invention, utilizing electromechanical components.
Figure 4B:
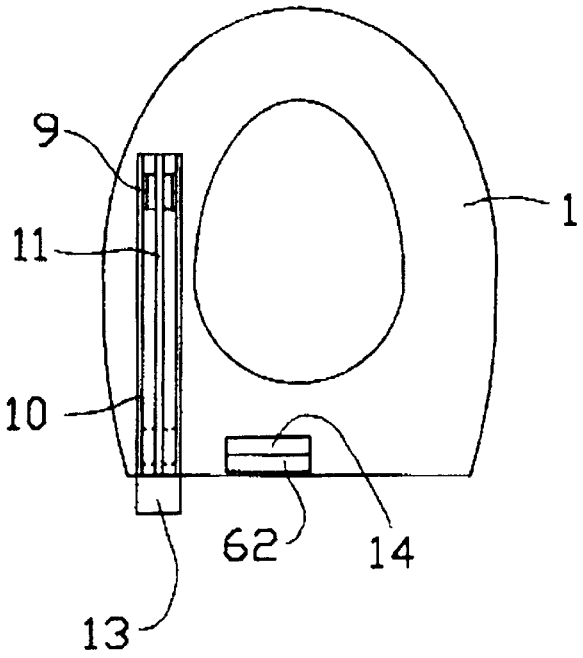
FIG. 4B is a plan view of a toilet seat incorporating the second embodiment invention.
Figure 4C:
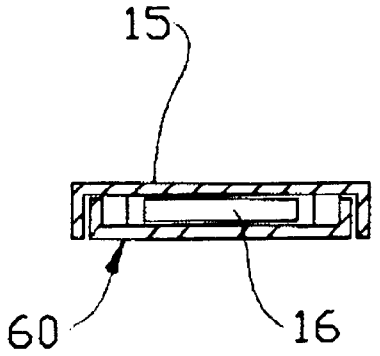
FIG. 4C is a partially sectional view of the foot operated sensor pad incorporated in the second embodiment of the invention utilizing electromechanical components.
Figure 5A:
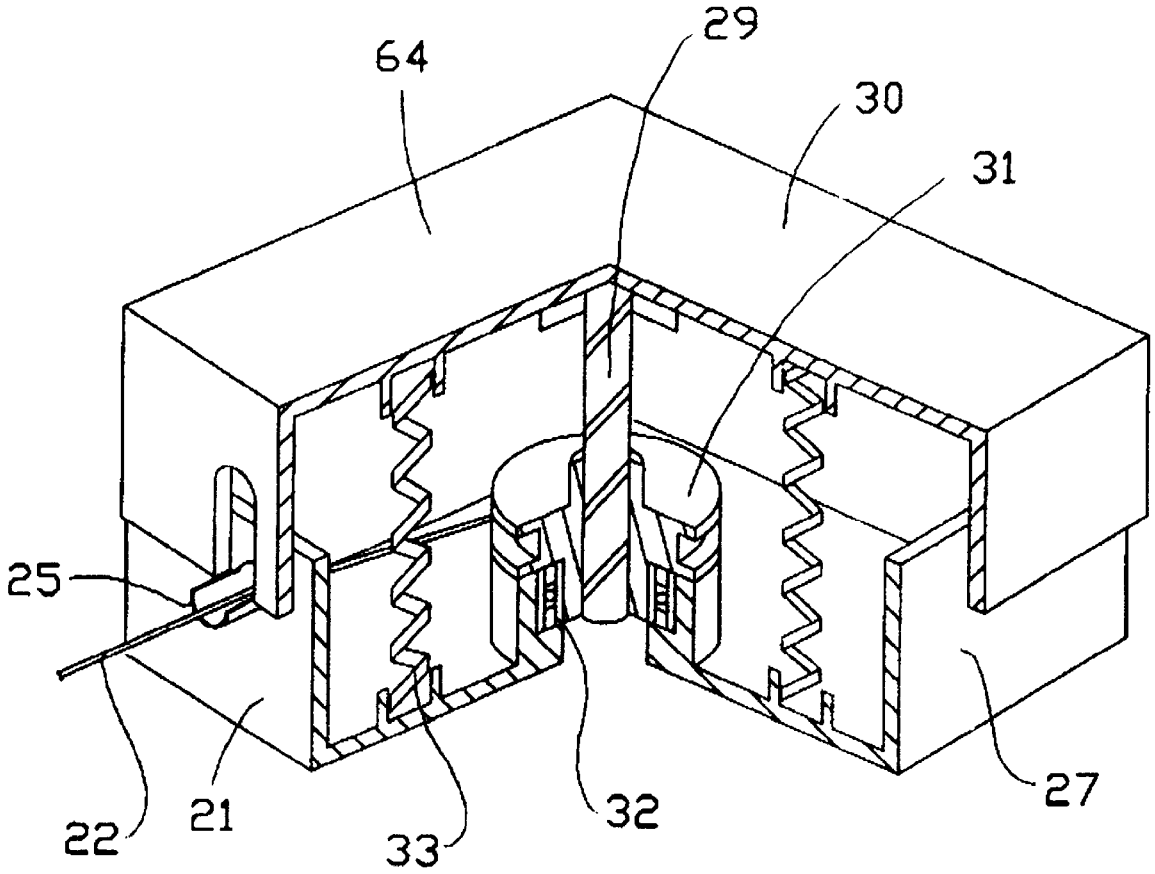
FIG. 5A is a perspective, partially broken away view of a foot operated sensor pad showing internal components of a third embodiment of the invention utilizing mechanical components.
Figure 5B:
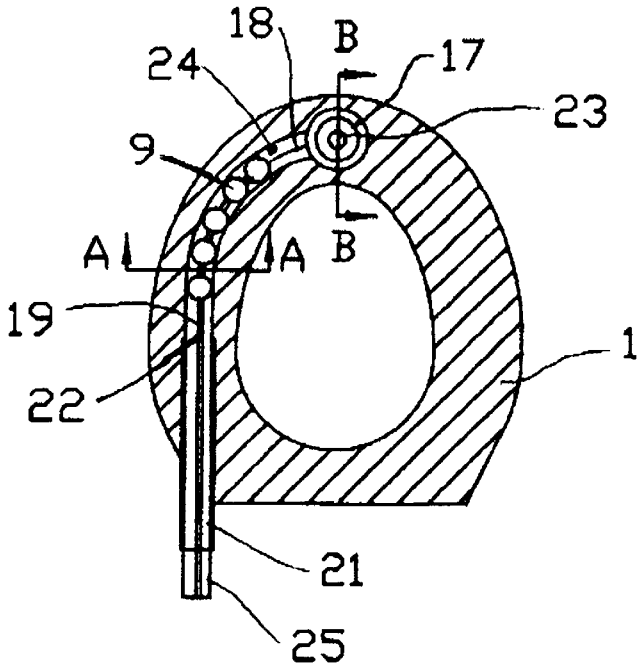
FIG. 5B is a partially sectional plan view of a toilet seat and counterweighting arrangement incorporated in the third embodiment of the invention.
Figure 5D:
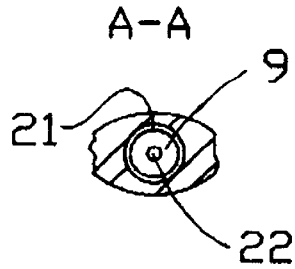
FIG. 5D is a view of the section A—A in FIG. 5C.
Figure 5E:
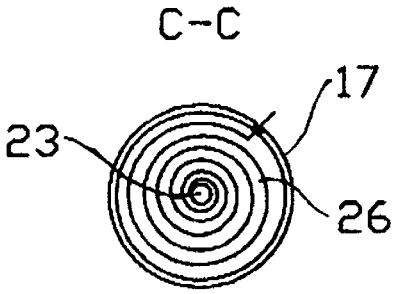
FIG. 5E is a view of the section C—C in FIG. 5C.
Figure 5C:
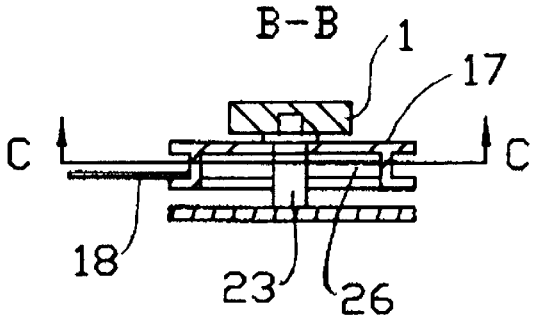
FIG. 5C is a side elevational view in partial section of a retraction pulley shown in FIG. 5B.

FIG. 3E shows a variation in which a reversible electric motor 13A drives a pump 82, which transfers liquid to and from a cavity 6B in the tubular counterweight 8A and a bladder cavity 3A at the forward end of the seat 1A via line 4A.

A sensor pad 5A controls energization of the motor 13A to transfer liquid to create the imbalance raising the seat, with a reverse transfer upon removal of foot pressure acting to create the lowering imbalance.

FIGS. 4A—4C and FIG. 9 show an electromechanical arrangement for alternatively creating an imbalance about the seat fulcrum tending to raise or lower the toilet seat.

Figure 9:
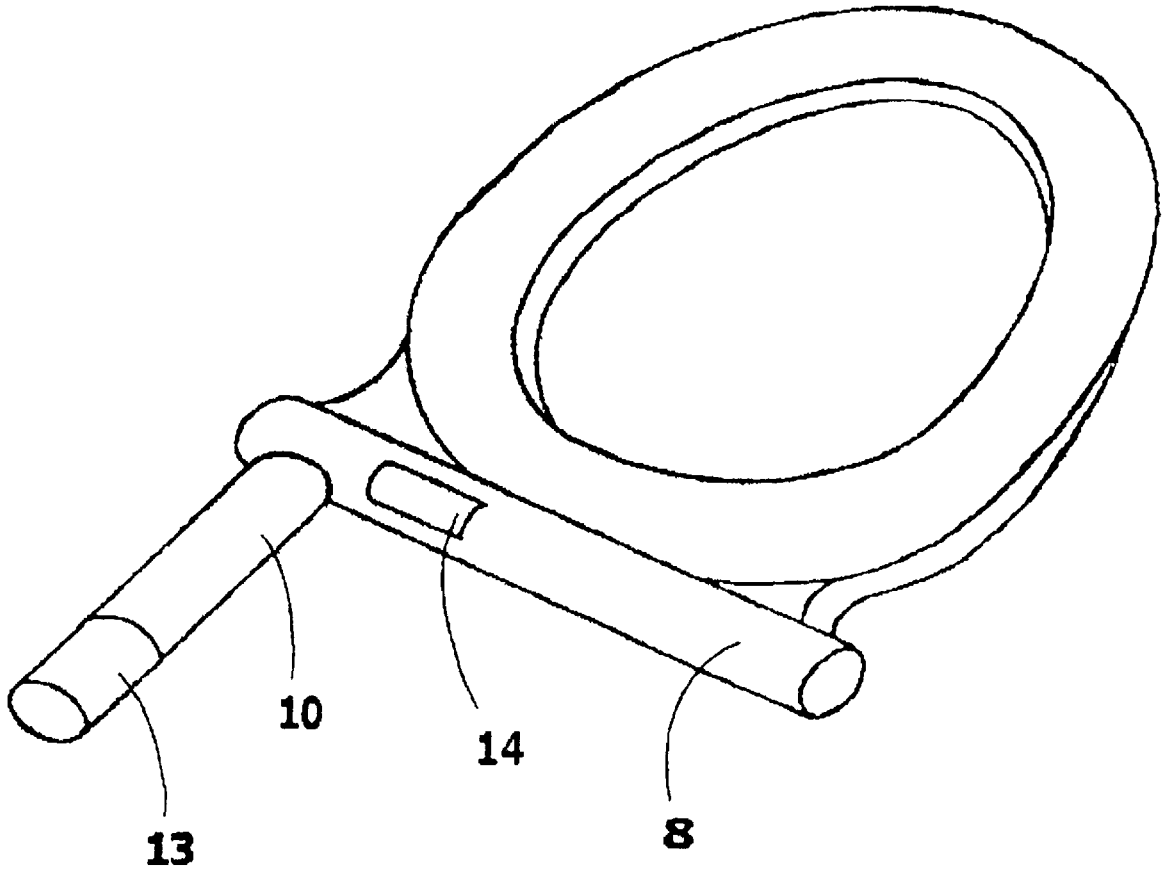
FIG. 9 is a perspective view of a toilet seat showing an electric drive motor used in the electromechanical embodiment.

This includes a small reversible electric motor 13 powered by a battery 14, both mounted to the rear of the seat 1 (FIG. 9). The motor 13 drives an elongate screw shaft 11 within a tube 10 extending within the seat interior in a front to rear direction. A weighted nut 9 is engaged by the screw shaft 11 so as to travel forwardly and rearwardly with respect to the seat 1 when the motor 13 is activated for driving in either direction. This causes an imbalance tending to raise the seat 1 when the weighted nut is driven to a rearmost position (shown in phantom), and to lower the seat when driven to a forward position within the seat 1.

The sensor pad 15 comprises a switch housing 60 causing activation to energize the motor 13 when stepped on, initiating rotation of the screw shaft 11 in a direction moving the weighted nut 9 to the rear position with respect to the fulcrum.

Instead of wiring, a radio transmitter 16 can send signals to the motor control circuit 62. When the switch is opened, the circuitry 62 causes the motor 13 to be reversed and drive the weighted nut 9 to its forward position with respect to the fulcrum.

The rate of drive of the motor may be set so as to produce a controlled rate of ascent and descent of the toilet seat, avoiding impacting of the seat.

FIGS. 5A–5E show a mechanical actuation means for shifting weight within the toilet seat 1.

FIG. 9 shows that the tube 10 can extend well outside the seat 1.

In this embodiment, a sensor pad 64 comprises an interfit base 27 and cover 30. A screw shaft 29 is affixed to the cover 30 extends down into a pulley 31 supported by bearing 32 in a base projecting up from the inside of the base 22.

A set of return springs 33 urge the cover 30 and base 27 to be separated.

A cable 22 is wound on the pulley 31 and within a guide tube 25 and into a weight guide tube 21 arranged extending front to rear within a cavity in the toilet seat 1. A series of weights (such as lead balls) are attached along the cable 22 within tube 21. A second cable 18 extends onto a housing 17 for a wind up spring 26 anchored on pin 23.

The cable 18 tends to pull the cable 22 so as to advance the weight 9 forwardly. When foot pressure is applied, the cable 22 is wound onto the pulley 31, shifting the weights 9 rearwardly, creating an imbalance causing the seat 1 to be raised.

When foot pressure is removed, the spring 26 moves the weights 9 forwardly to create an imbalance causing the seat to be lowered.

Figure 6:
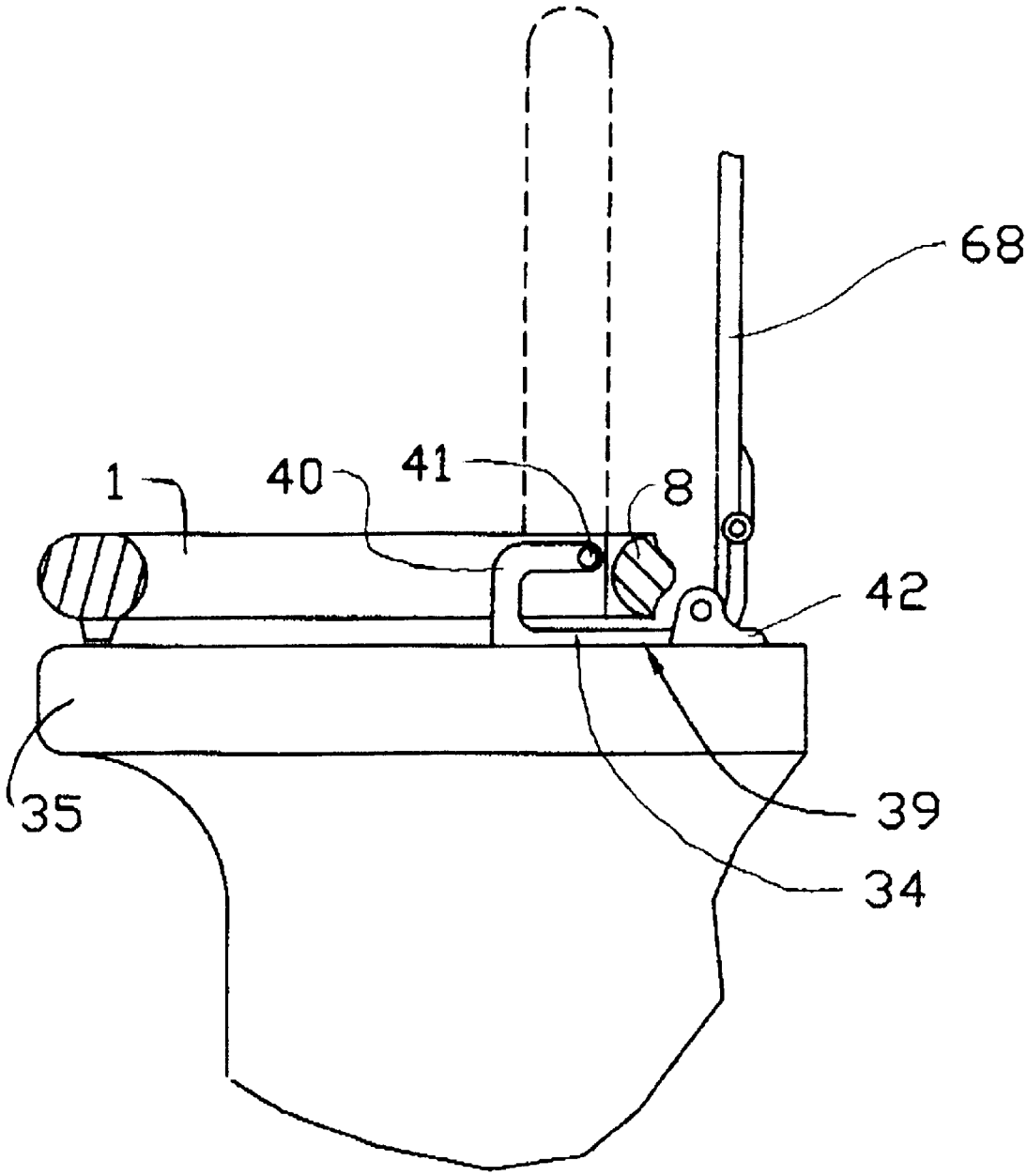
FIG. 6 is a fragmentary side view of a toilet bowl and a partially sectional view of a toilet seat showing a fulcrum hinge and counterweight, and a special bracket.
Figure 6A:
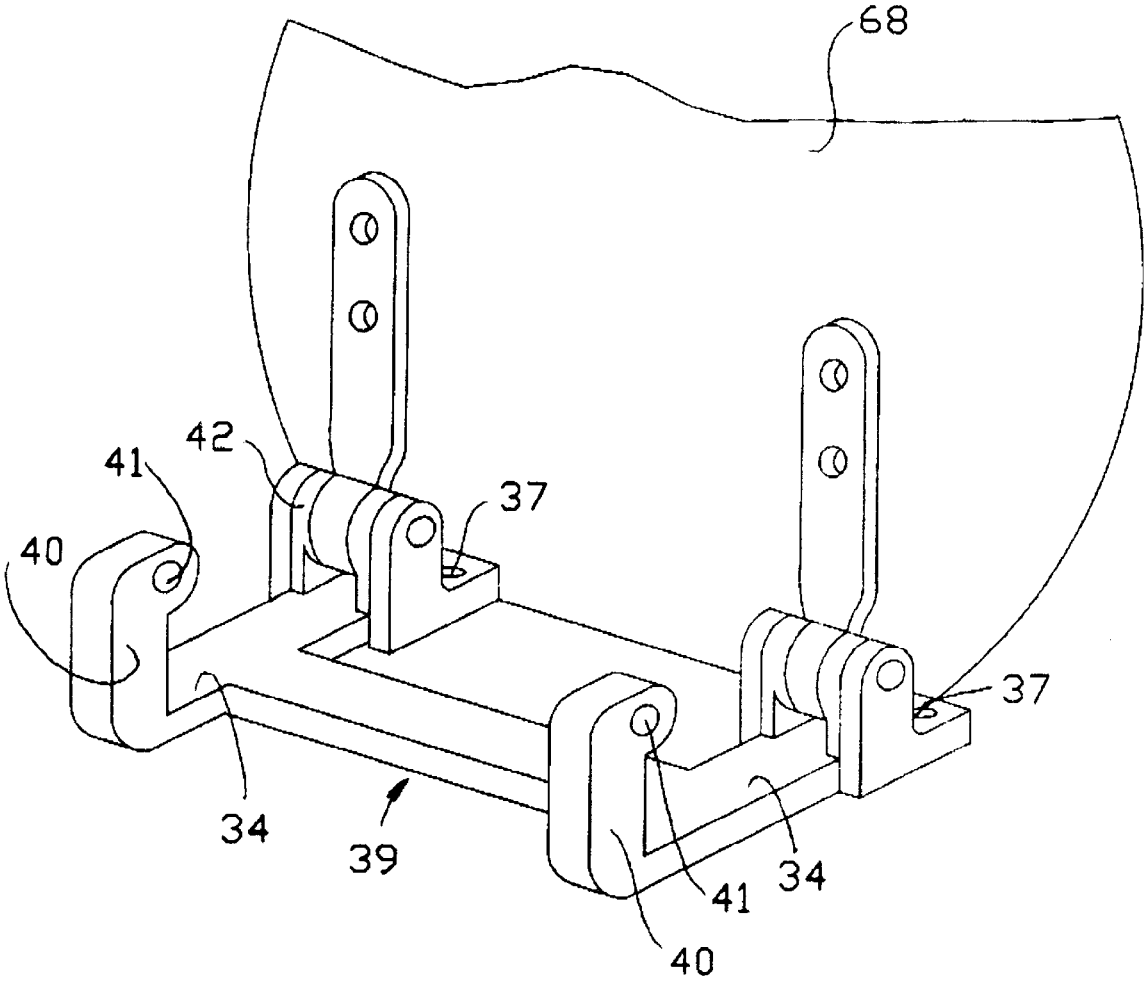
FIG. 6A is a perspective view of the components shown in FIG. 6.

FIGS. 6 and 6A show a hinge design which facilities mounting of the toilet seat 1 to standard mounting holes 37 by a special bracket 39. The special bracket 39 includes a pair of mounting members 34, each having a hinge piece 40 extending upwardly. This arrangement extends hinge holes 41 acting as the fulcrum point forwardly of the standard mounting holes 37 to allow clearance for the counterweight 8. A cover 68 is mounted to hinges 42 in conventional fashion.

Figure 7:
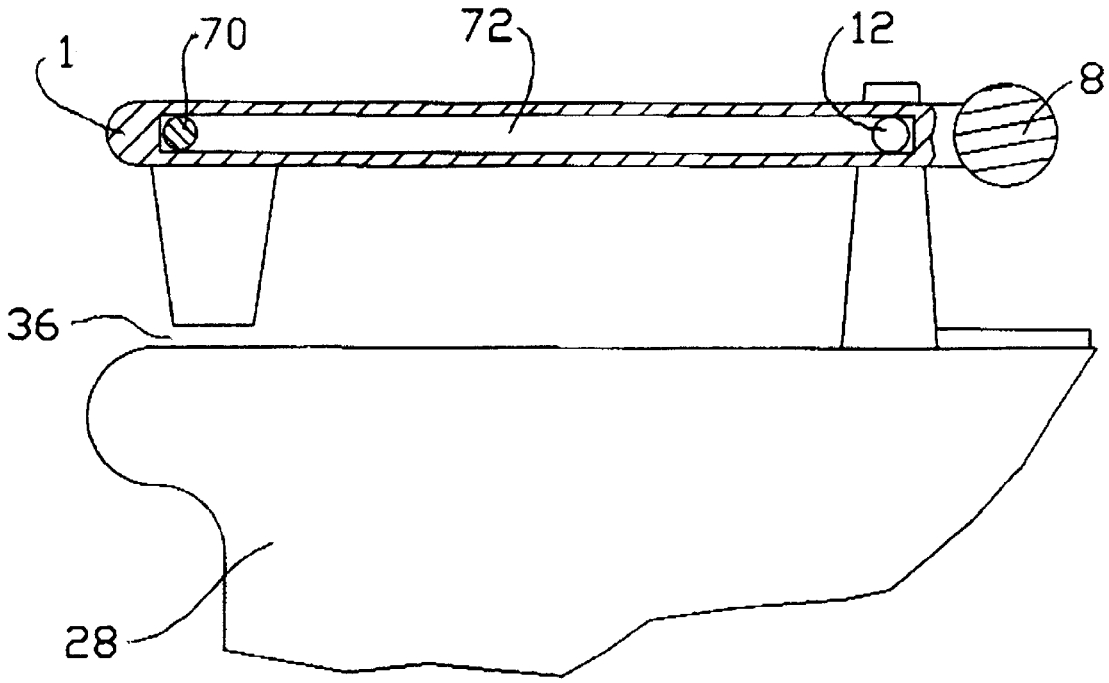
FIG. 7 is a fragmentary side view of a toilet bowl and a sectional view of an associated toilet seat demonstrating an operation principle of the invention.
Figure 7A:
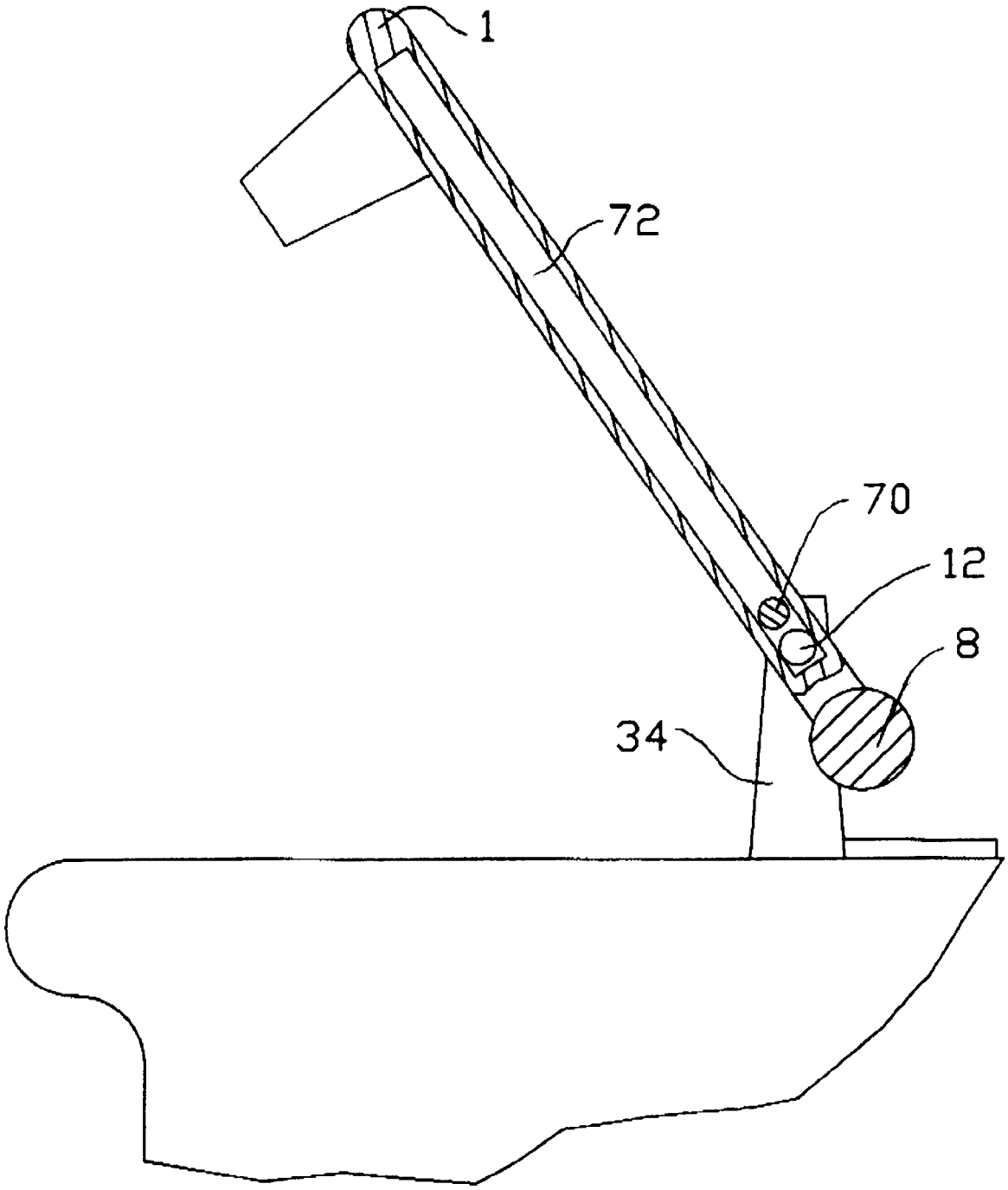
FIG. 7A is a side view with the toilet seat raised.

FIGS. 7 and 7A illustrate diagrammatically that a shifting weight 70 inside a passage 72 in the toilet seat 1 pivoted on fulcrum 12 can be moved from a forward position to one closer to or over the fulcrum 12 so as to cause varying imbalances with the counterweight 8; or, the weight can be shifted to a point to the rear of the fulcrum 12 and over the counterweight 8 by extending the seat 1 and passage 72.

The transfer of weight to either side of the fulcrum 12 reduces the amount of weight which needs to be shifted to create the desired imbalances. A higher clearance over the bowl rim 19 may facilitate accommodating the extra length to the rear of the fulcrum 12. The special hinge bracket described below alleviates the need for a higher seat. An air gap 36 between the seat 1 and bowl 35 could be provided, as shown, to allow initial adjustments during installation, although this is not preferred.

Figure 8:
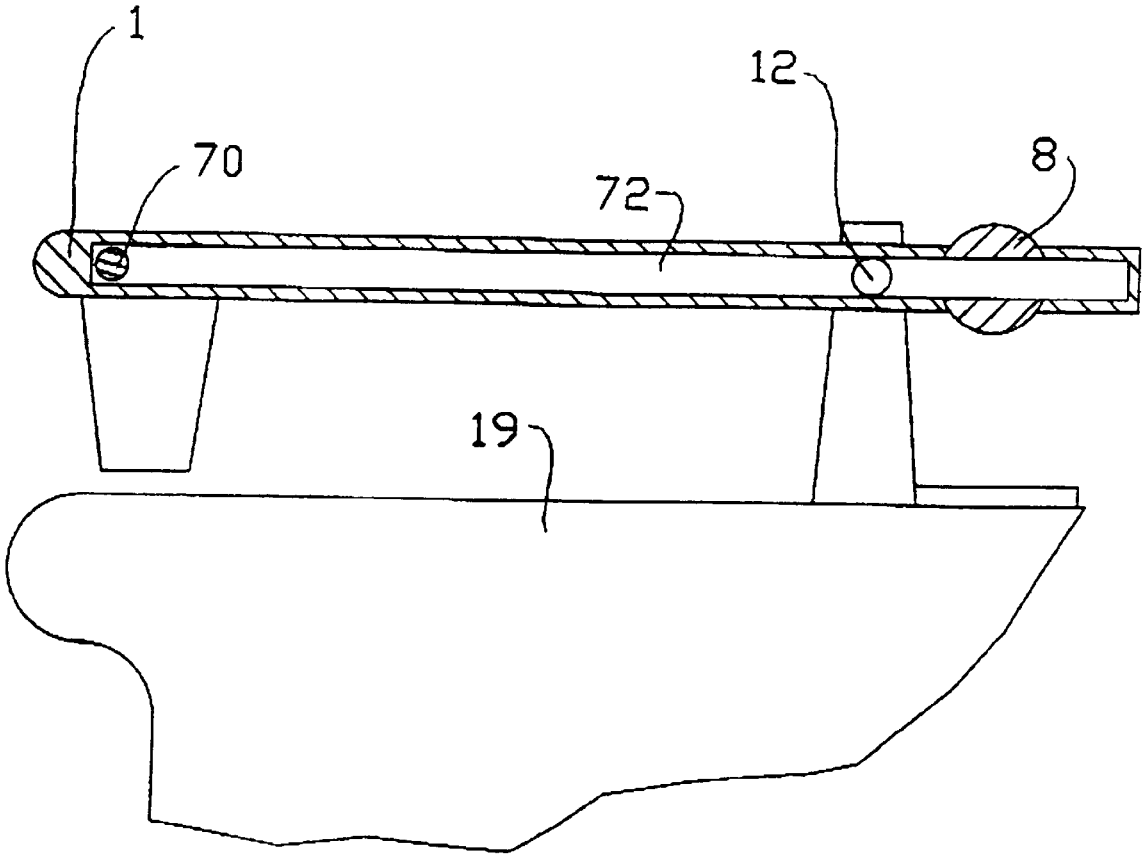
FIG. 8 is a fragmentary view of a toilet bowl and a sectional view of an associated toilet seat, and a diagram demonstrating a variation of the operating principle of the invention.
Figure 8A:
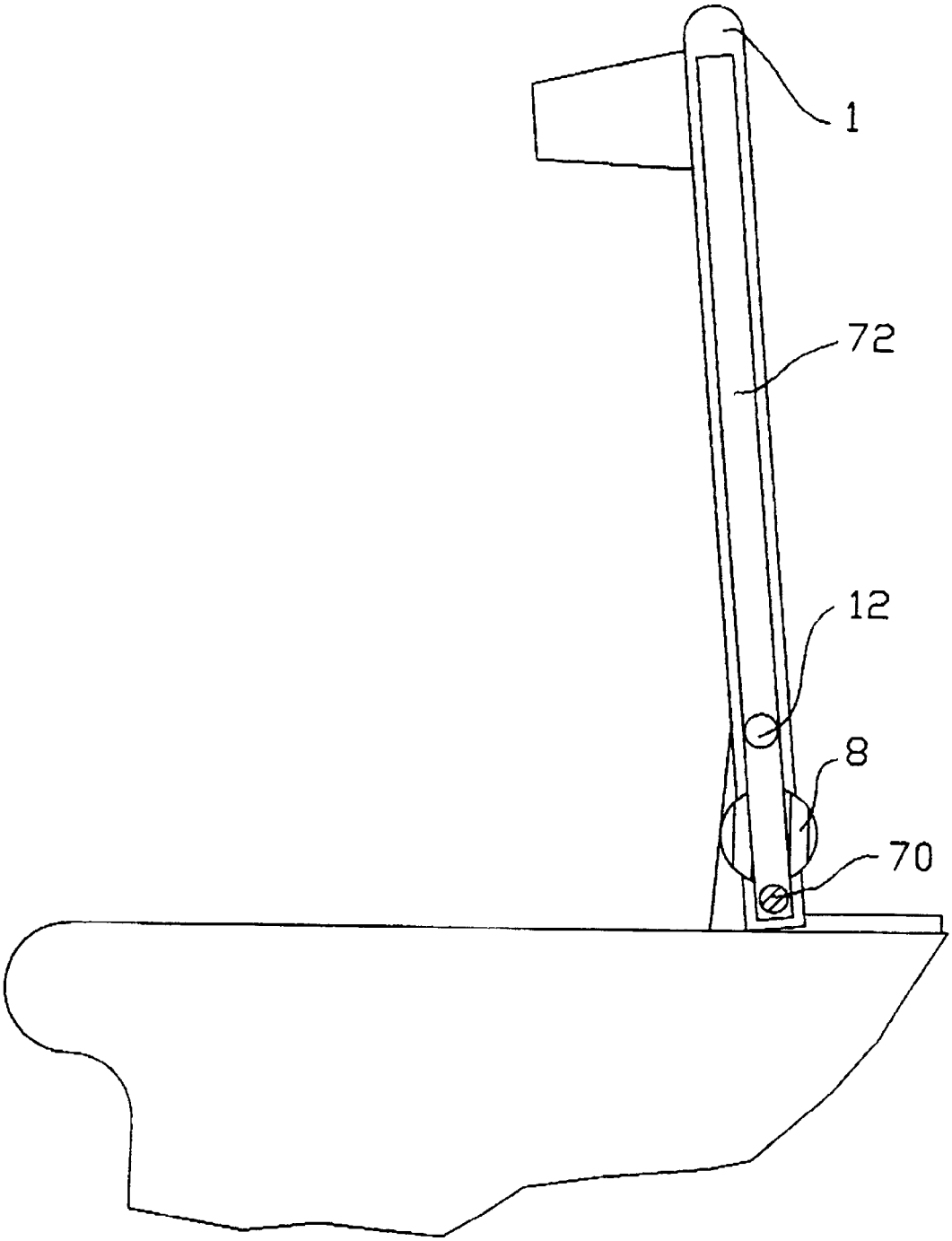

FIG. 8 and 8A show that the passage 70 can be extended to the rear to increase the leverage of the weights 70 and 8.

Figure 10A:
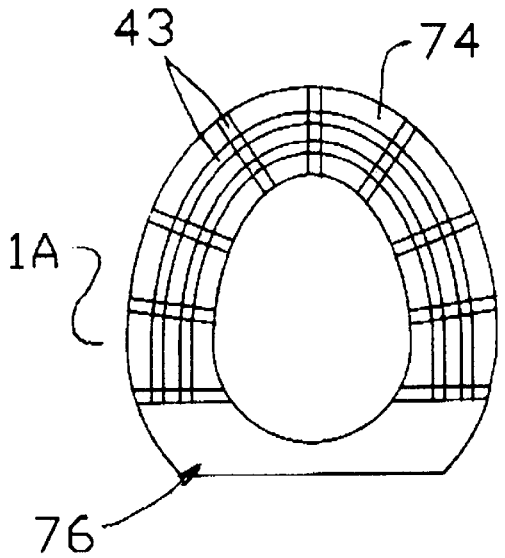
FIG. 10A is a plan view showing a partially hollow toilet seat of internally ribbed construction with a bottom cover piece removed.
Figure 10B:
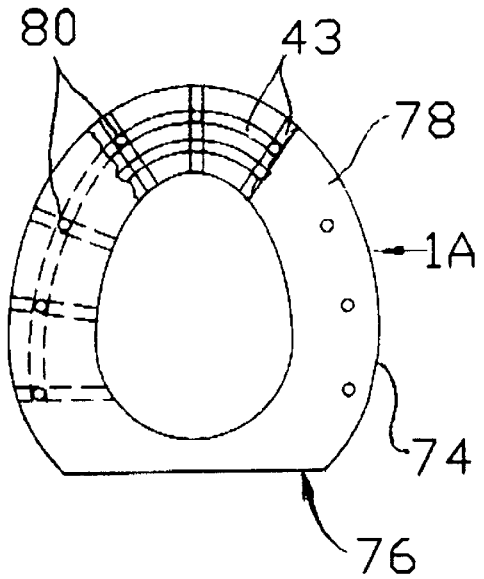
FIG. 10B is a plan view of the ribbed toilet seat construction with the cover partially broken away.
Figure 10C:
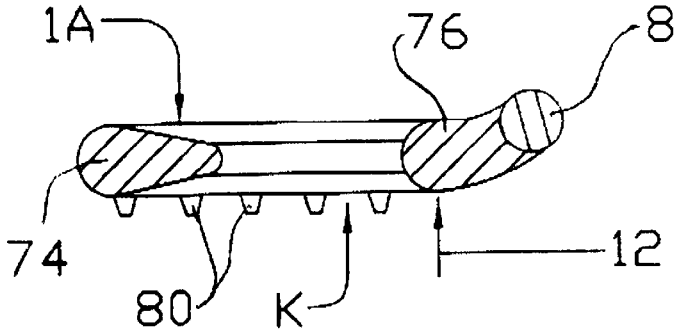
FIG. 10C is a sectional view of a toilet seat of a composite construction having a lightweight hollow portion and a heavy solid portion on either side of a fulcrum.

FIGS. 10A, 10B, and 10C show details of a construction of the toilet seat 1 which allows imbalances to be established without resorting to heavy weights, etc.

FIG. 10A shows a hollow, molded plastic construction of a forward lightweight section 74 of a toilet seat 1A, the rear, heavier section 76 is of a solid construction to contribute to the counterweighting about the fulcrum. A network of radial and circumferential stiffening ribs 40 are molded into the interior of the hollow section 74 for adequate strength. A cover 78 (FIG. 10B) is bonded onto the open bottom of the seat, with a series of pads 80 aligned with rib intersections provided to give adequate support for the hollow section.

FIG. 10C illustrates how the different density portions 74, 76 and counterweight 8 assist in counterweighting about fulcrum 12.

We claim:

1. In combination with a toilet including a toilet bowl and a toilet seat and a hinge mounting therefore allowing said toilet seat to be pivoted between a lowered position resting atop a rim surface of said toilet bowl to a raised position upright with respect to said toilet bowl; an arrangement for raising and lowering said toilet seat, said arrangement comprising:

a fulcrum defined by said hinge mounting, the weight of said toilet seat on one side of said fulcrum and a counterbalancing weight to the rear of said fulcrum;

means for shifting said counterbalancing weight supported by said toilet seat relative to said fulcrum with said seat in a lowered position so as to cause said toilet seat to thereafter pivot up on said fulcrum from a resulting imbalance thereof, and also for shifting said counterbalancing weight relative to said fulcrum with said toilet seat in said raised position so as to thereafter cause a pivoting down of said toilet seat.

2. The combination according to claim 1 wherein said means for shifting said counterbalancing weight includes a floor mounted sensor pad positioned just forwardly of said toilet bowl sized and located so that the forward portion of a standing user's foot will rest thereon, while a seated user's heels will not rest thereon, and means responsive to foot pressure normally exerted on said sensor pad by the forward foot portion of a user standing in front of said toilet bowl to cause shifting of said weight so as to create an imbalance causing said toilet seat to pivot to said raised position.

3. The combination according to claim 2 wherein said means for shifting weight comprises a mechanical activation and a cable movable in one direction by said mechanical actuator by foot pressure on said sensor pad, and retraction means restoring said cable to its original position upon release of said foot pressure, said cable pulling weight connected thereto and supported in said toilet seat, to shift said weight to the rear of said toilet seat to create an imbalance raising said toilet seat.

4. The combination according to claim 1 wherein said means for shifting weight includes a drive motor and a drive mechanism associated with a weight supported on said toilet seat, said drive motor energized by means responsive to foot pressure on said sensor pad to cause said weight to be shifted to cause an imbalance tending to pivot up and raise said toilet seat.

5. The combination according to claim 1 wherein said means for shifting weight comprises means for causing flow of liquid from a cavity in a toilet seat to create an imbalance raising said toilet seat.

6. The combination according to claim 5 wherein said means for causing liquid flow includes air pressure means developed by foot pressure on a sensor pad exerted on a volume of liquid in said cavity to displace the same from said cavity.

7. The combination according to claim 6 wherein said liquid is displaced to an external accumulator reservoir causing return flow to said cavity when said pressure means is relieved.

8. The combination according to claim 6 wherein said pressure means includes a bladder in said cavity expandable by foot pressure on said sensor pad.

9. The combination according to claim 5 wherein said cavity is at a forward location in said toilet seat.

10. The combination according to claim 9 wherein said liquid is transferred to a second cavity located in said toilet seat to the rear of said fulcrum.

11. The combination according to claim 1 wherein said weight is shifted to a location forward of said fulcrum in lowering said toilet seat.

12. The combination according to claim 1 wherein said weight is shifted to a location to the rear of said fulcrum in raising said toilet seat.

13. The combination according to claim 1 wherein said means for shifting weight comprises a pump activated by said sensor pad in response to foot pressure thereon to pump liquid between said cavities.

14. The combination according to claim 1 wherein said toilet seat has a hollow forward portion and a rear heavier portion, said heavier portion counterweighting said hollow portion of said toilet seat.

15. The combination according to claim 14 wherein reinforcing ribs are formed within said hollow toilet seat portion.

16. A method of raising a toilet seat from a fully lowered position and lowering said toilet seat from a fully raised position, said toilet seat having a hinged support at a rear portion of said toilet seat, comprising the steps of:

counterbalancing said toilet seat with respect to said hinged support to create a fulcrum at said hinged support;

controllably creating a weight imbalance about said fulcrum with said toilet seat in said fully lowered position to thereafter raise said toilet seat by shifting weight on said seat towards said fulcrum; and controllably creating a weight imbalance about said fulcrum with said toilet seat in said fully raised position to thereafter lower said toilet seat by shifting weight on said seat away from said fulcrum.

* * * * *